United States Patent [19]

Roppatte, Jr.

[11] 4,354,512

[45] Oct. 19, 1982

[54] LIQUID APPLICATOR DEVICE WITH HAIR-PARTING WAND

[75] Inventor: Michael Roppatte, Jr., Garfield, N.J.

[73] Assignee: Stefan J. Klauber, West Orange, N.J. ; a part interest

[21] Appl. No.: 910,471

[22] Filed: May 30, 1978

[51] Int. Cl.[3] ..... A45D 40/30

[52] U.S. Cl. ..... 132/88.5

[58] Field of Search ..... 132/88.5, 7, 85, 9; 15/165, 184, 257.7, 111, 114, 121

[56] References Cited

U.S. PATENT DOCUMENTS

| | | | |
|---|---|---|---|
| 2,663,889 | 12/1953 | Fuglie | 15/184 X |
| 2,819,723 | 1/1958 | Meyer | 132/9 |
| 2,895,486 | 7/1959 | Sayer | 132/9 |
| 3,480,020 | 11/1969 | Ernest | 132/88.5 |

*Primary Examiner*—G. E. McNeill

*Attorney, Agent, or Firm*—Weingram & Klauber

[57] ABSTRACT

A liquid applicator device is disclosed, useful in applying bleaching or coloring compositions or the like to the hair in the course of cosmetically treating same. The device comprises a compressible container for receiving the composition; a cap closure being removably secured to the top of the container and including an opening therethrough for feeding the composition upon manual compression of the container. Brush means, including liquid distribution means, extend from the cap and are in communication with the cap opening to enable feed of the composition to the brush. A hair-parting wand extends from the cap at an angle diverging from the direction of extension of the brush, whereby a user of the device may employ the wand to part and separate the hair and thereupon utilize the brush to apply the treating composition.

7 Claims, 4 Drawing Figures

LIQUID APPLICATOR DEVICE WITH HAIR-PARTING WAND

BACKGROUND OF INVENTION

This invention relates generally to apparatus useful in the art of hair-dressing, and more specifically relates to a liquid applicator device useful in applying bleaching and coloring compositions to the hair.

Particularly in the course of effecting hair-dressing operations upon women's hair, the hair-dressing operator is called upon to skillfully treat the hair to effect such operations as highlighting, toning, bleaching, streaking or frosting, all of the cited terms being well-known to those skilled in the pertinent art. Such operations require the use of relatively skilled techniques to manipulate the hair and thereupon apply to same liquid compositions which may effect bleaching or coloring of the hair in varying degrees, or may effect selective degrees of bleaching and coloring in accordance with the effect desired.

In the common procedure utilized by the hair-dresser in carrying out the foregoing operations, the treating solution, be it a bleach, dye or composite solution or the like, is maintained in a distinct container or reservoir, such as a bowl or the like. The operator positions this reservoir at a convenient location, and utilizes for application of the commposition, a brush which is periodically dipped into the container. Intermittently the operator utilizes a separate hair-parting instrument—e.g. the "rattail" end of a common rattail-comb—to periodically part the hair in order to render accessible portions of same which are to be treated. The sequence of operation thus involves a continuing alternation of instruments, including in such alternation the repeated dipping of the brush into the composition reservoir, and repeated (but necessary) movement of the operator's hands away from the hair work area.

The operations required pursuant to the foregoing approach are not only cumbersome, but tend to be ineffective from an efficiency and artistic viewpoint. Indeed, a great degree of skill is required to manually carry out the cited sequence of steps—this quite aside from the operator's talent in carefully applying the composition to the hair.

Pursuant to the foregoing, it may be regarded as an object of the present invention, to provide a liquid applicator device useful in carrying out such hair-dressing operations as highlighting, toning, bleaching, streaking, frosting or the like, which device enables the operator to simply and effectively conduct the said operations without using separate instruments, and without diverting his or her attention from the work area.

SUMMARY OF THE INVENTION

Now in accordance with the present invention, the foregoing objects and others as will become apparent in the course of the ensuing specification, are achieved in a liquid applicator device useful for applying compositions to the hair in the course of cosmetically treating same. The device finds application in the course of applying compositions useful in highlighting, toning, bleaching, streaking or frosting, or in similar operations pertinent to cosmetically treating hair.

A device in accordance with the invention may comprise a compressible container for receiving the composition to be dispensed. A cap closure is removably secured to the top of the container and includes an opening therethrough for feeding the composition upon manual compression of the container body. Brush means, including liquid distribution means, extend from the top of the said cap and are in communication with the cap opening to enable feed of the composition to the brush upon container compression. Pursuant to the invention, a hair parting wand, as for example of the well-known tapering "rattail" variety, may extend from the cap at an angle which diverges from the direction of extension of the brush means. In consequence, a user of the said device may readily employ the wand to part and separate the hair, and thereupon utilize the brush means to skillfully apply the composition to the parted hair.

The angle of divergence between the brush and the wand is at least 15°, and preferably about 25° and 45°. The brush means may extend along the longitudinal axis of the container, with the distal end of the brush and the tip of the wand lying approximately on a line perpendicular to the said longitudinal axis, to thereby enable manipulation by the operator of the device between the liquid application and hair parting positions of the device. In typical embodiments of the device, the lateral separation between the distal end of the brush and the wand tip is between about 2 and 5 inches, as this is found to provide a relatively optimal spacing permitting the foregoing operations without either the brush and wand interferring with use of each other.

BRIEF DESCRIPTION OF DRAWINGS

The invention is diagramatically illustrated, by way of example of the drawings appended hereto, in which.

DESCRIPTION OF PREFERRED EMBODIMENT

Figure 1:
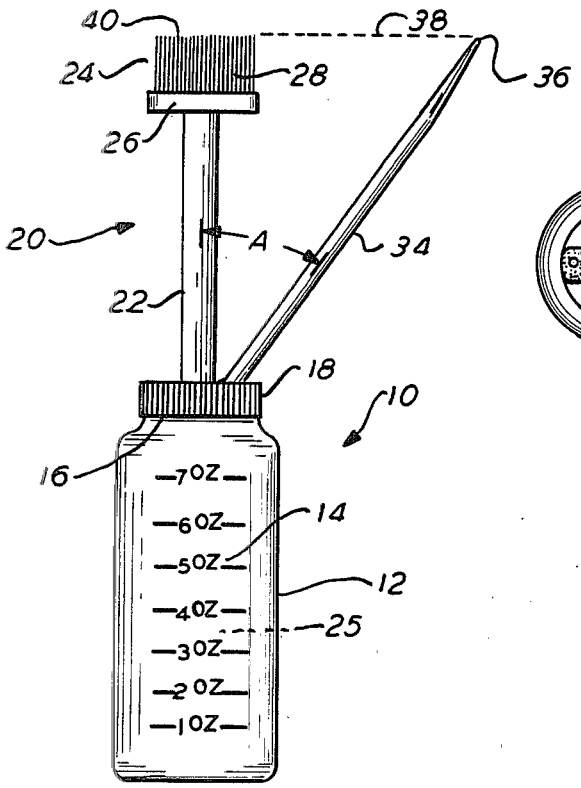
FIG. 1 is an elevational view of a first embodiment of a device in accordance with the present invention.
Figure 2:
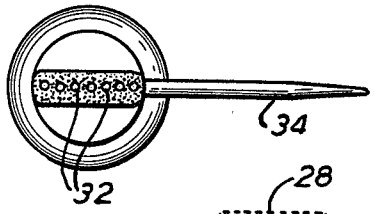
FIG. 2 is a top plan view of the device of FIG. 1.
Figure 3:
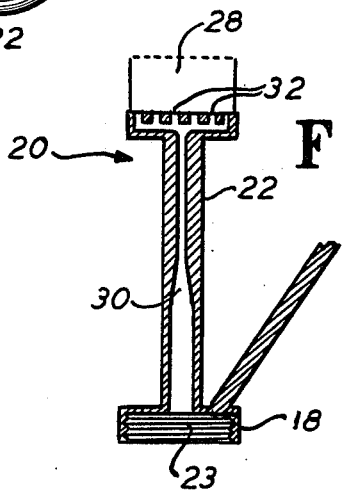
FIG. 3 is a longitudinal, cross-sectional view through the cap and associated brush and wand structure.

Referring to FIGS. 1, 2 and 3 herein, an applicator device 10 in accordance with the invention is set forth. Device 10 is seen to include a reservoir or container 12, which is per se of generally conventional design, and which is intended to receive the treating solution or composition utilized in the present device. Typically, container 12 will include visual marking indicia 14 formed thereon, specified for example in fluid ounces. Such indicia, as is known in this art, are useful in the course of preparing the treating solutions, i.e. in some instances these solutions or compositions are prepared by mixing two or more components.

Container 12 preferably comprises a compressible flexible plastic material, such as polyethylene or the like; i.e. this container is of the well-known "squeeze bottle" variety, it being the objective of the present structure to enable liquid to be dispensed by manual compression of the said container. The manual compression, i.e. the pumping action thereby effected, is usually necessary when dispensing compositions of the most common type to which the present device is applicable—in that such compositions are often quite viscous, and do not flow readily under mere gravitational influence.

The top end of container 12 is open, and is provided with conventional threads 16. A cap 18, of plastic, metal or other suitable material, carries internal mating threads, and is received by being threaded upon the top open end of container 12.

Extending upwardly along the longitudinal axis of container 12, is a brush means generally indicated at 20. Such brush means includes an extended neck 22, which as seen in FIG. 3 is in communication with the cap opening 23, and therefore with the interior 25 of container 12. Neck 22 terminates at a brush 24, which includes a base 26 and bristle portion 28.

By reference to FIG. 3, it is seen that an internal channel 30 passing through neck 22, forms part of a liquid distribution system which includes a plurality of ports or outlets 32 at base 26 of brush 24. These ports 32 permit the liquid from container 12, upon compression of the latter, to be extended into the bristles 28, to enable application to the hair.

Pursuant to the invention it is further seen that a hair-parting wand 34 extends from cap 18 at an angle A with respect to the direction of extension of brush means 20. Wand 34 may per se resemble—although in a somewhat extended form—the "rattail" portion of a so-called "rattail" comb. The wand is used to part the hair during the use of the present device in the hair-dressing operations previously mentioned.

The angle A is referably at least 15°, and more generally between about 25° to 45°, with 30° to 35° being a relatively optimal angle.

The tip 36 of wand 34 preferably resides approximately on a line 38 which about coincides with the distal end 40 of bristles 28 and is perpendicular to the longitudinal axis of container 12 and neck 22 of the brush means. When coupled with the diverging angle A previously mentioned, this provides a typical separation between the distal end 40 of the brush and wand tip 36 of the order of 2 to 5 inches. With the said distal end 40 and tip 36 lying on the common line 38, and the indicated separation, a relatively optimal use of device 10 may be achieved, i.e. with this arrangement the operator may most readily manipulate the device 10 between its liquid applicator positions, and its hair-parting positions, without the wand 34 or brush means 20 interferring with one another in use. All these operations may of course be readily effected with but one hand, and there is no necessity to move the device 10 away from the work area, i.e. from the hair during the said operations.

Figure 4:
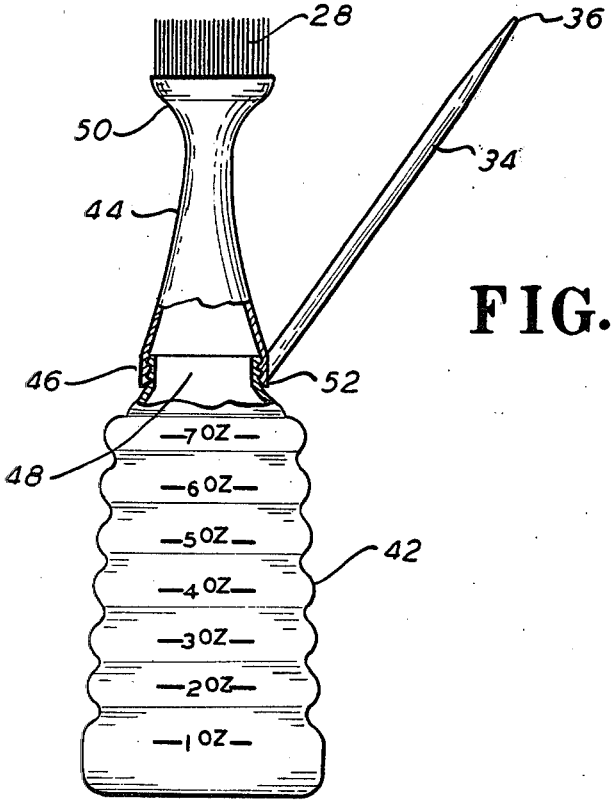
FIG. 4 is a side elevational view, partially sectioned, showing a further embodiment of a device in accordance with the invention.

In FIG. 4 herein, an elevational view, partially sectioned, appears of a further embodiment of the present device. The apparatus shown is in most respects similar to that of FIGS. 1, 2 and 3. It will, however, be noted firstly that the container 42 differs somewhat from container 12, in having more rounded side walls—which renders the container comfortable to grasp and easy to use.

The embodiment of FIG. 4 has a yet further, significant advantage. In particular it will be seen that the neck 44 at its lower or base end 46, has an opening substantially as wide as that of the passageway 48 through the cap. This is especially advantageous for present applications, since the aforementioned high viscosity of the compositions often used in the present device, tend to prevent ready flow of same—a condition rectified by the instant arrangement. At the upper end of neck 44 it is seen that the walls of same flare out at 50, to provide a fluid distribution system substantially similar to that shown in the cross-sectional view of FIG. 3. It is also to be noted in the present arrangement, that the wand 34 is now secured to the cap at its side or periphery 52, instead of being secured at the upper side thereof.

It will be appreciated that the entire structure including the cap, brush means and wand, may in the device shown, be formed substantially as a molded unit (except for the bristles 28 which can be inserted by customary techniques); or the various elements can be separately formed and joined by known methodology.

It will also be appreciated that the structure including the cap, wand and associated brush means can be made in various sizes as to enable the use of these elements in combination with standard "off the shelf" squeeze bottles.

While the present invention has been particularly set forth in terms of specific embodiments thereof, it will be understood in view of the present disclosure, that numerous variations upon the invention are now enabled to those skilled in the art, which variations yet reside within the scope of the present teaching. Accordingly the invention is to be broadly construed, and limited only by the scope and spirit of the claims now appended hereto.

I claim:

1. A liquid applicator device for applying compositions to hair in the course of cosmetically treating same; said device comprising: a compressible container for receiving said composition; a cap closure being removably secured to the top of said container, and including an opening therethrough for feeding said composition upon manual compression of said container body; brush means including liquid distribution means extending from said cap along the longitudinal axis of said container and being in communication with said cap opening to enable feed of said composition to said brush upon said container compression, the applicator face of said brush means being transverse to said longitudinal axis at the upper distal end of said device; and a hair-parting wand extending from said cap at an angle diverging from the direction of extension of said brush means, the length and divergence angle of said wand being such that the perpendicular from the distal end to said brush to said wand intersects the wand substantially below the wand tip, whereby a user of said device may employ said wand to part and separate said hair without interference by said brush means, and thereupon utilize said brush means to apply said composition to the parted hair.

2. A device in accordance with claim 1, wherein the angle of divergence between said brush and said wand is at least 15°.

3. A device in accordance with claim 2, wherein said angle is about 25° to 45°.

4. A device in accordance with claim 1, wherein the opening of said cap extends substantially across the width thereof, to enable ready flow of highly viscous compositions; and wherein said liquid distribution means for said brush means are connected to said cap opening by an extended hollow neck piece passing between said opening and the brush portion of said brush means.

5. A device in accordance with claim 2, wherein said wand comprises a tapering "rattail".

6. A device in accordance with claim 3, wherein the distal end of said brush means and the tip of said wand lie approximately on a line perpendicular to the said longitudinal axis, thereby enabling ready manipulation by said operator of said device between the liquid application and hair parting positions of said device.

7. A device in accordance with claim 6, wherein the lateral separation between said distal end of said brush means and said wand tip is between 2 and 5 inches.

* * * * *